US010145601B2

(12) United States Patent
Kono et al.

(10) Patent No.: US 10,145,601 B2
(45) Date of Patent: Dec. 4, 2018

(54) OUTDOOR UNIT AND REFRIGERATION CYCLE APPARATUS INCLUDING THE OUTDOOR UNIT

(75) Inventors: Atsushi Kono, Tokyo (JP); Takahide Tadokoro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 697 days.

(21) Appl. No.: 14/361,034

(22) PCT Filed: May 10, 2012

(86) PCT No.: PCT/JP2012/003049
§ 371 (c)(1),
(2), (4) Date: May 28, 2014

(87) PCT Pub. No.: WO2013/094082
PCT Pub. Date: Jun. 27, 2013

(65) Prior Publication Data

US 2014/0299298 A1 Oct. 9, 2014

(30) Foreign Application Priority Data

Dec. 19, 2011 (JP) ..... 2011-277430

(51) Int. Cl.
*F24F 1/48* (2011.01)
*F24F 1/38* (2011.01)
(Continued)

(52) U.S. Cl.
CPC ..... *F25D 17/06* (2013.01); *F24F 1/38* (2013.01); *F24F 1/40* (2013.01); *F24F 1/46* (2013.01); *F24F 1/48* (2013.01)

(58) Field of Classification Search
CPC ..... F24F 1/38; F24F 1/48; F24F 1/54; F24F 1/56; F24F 1/12; F24F 1/40; F24F 1/027;
(Continued)

(56) References Cited

U.S. PATENT DOCUMENTS 4,156,706 A * 5/1979 Bell, Jr. ..... F28C 1/04 165/900
4,189,281 A * 2/1980 Katagiri ..... F04D 29/547 123/41.49
(Continued)

FOREIGN PATENT DOCUMENTS

JP 04-95232 U 8/1992
JP 04-278132 A 10/1992
(Continued)

OTHER PUBLICATIONS

International Search Report of the International Searching Authority dated Aug. 7, 2012 for the corresponding international application No. PCT/JP2012/003049 (and English translation).
(Continued)

*Primary Examiner* — David Teitelbaum
*Assistant Examiner* — For K Ling
(74) *Attorney, Agent, or Firm* — Posz Law Group, PLC

(57) ABSTRACT

An outdoor unit according to the present invention includes an air-sending-device chamber including a heat exchanger disposed at least on the rear side within an outdoor unit body, a propeller fan having a plurality of blades and disposed on the front side of the heat exchanger, and a bell mouth disposed on the front side of the propeller fan to face an air outlet, a machine chamber in which a compressor is disposed, and a partition plate that separates the air-sending-device chamber and the machine chamber. The partition plate has a protruding shape protruding from the air-sending-device chamber toward the machine chamber. The partition plate has, on the side of the air-sending-device chamber, a recessed area corresponding to the protruding shape. The amount of recess of the recessed area is maximized at a position equal in height to the center of rotation of the propeller fan.

9 Claims, 7 Drawing Sheets

(51) Int. Cl.

| | |
|---|---|
| ***F24F 1/54*** | (2011.01) |
| ***F24F 1/40*** | (2011.01) |
| ***F25D 17/06*** | (2006.01) |
| ***F24F 1/46*** | (2011.01) |

(58) Field of Classification Search

CPC ..... F24F 1/0029; F24F 1/10; F24F 13/081; F24F 13/20; F24F 2013/088; F24F 2013/202; F24F 2013/205; F24F 5/00; F24D 29/526; F04D 29/526; F04D 29/545; F04D 29/547

USPC ..... 62/262; 415/220, 222, 223

See application file for complete search history.

(56) References Cited

U.S. PATENT DOCUMENTS

| | | | | | |
|---|---|---|---|---|---|
| 5,248,224 | A * | 9/1993 | Amr | F04D 29/547 | 415/220 |
| 6,062,031 | A * | 5/2000 | Kim | F24F 1/027 | 62/262 |
| 6,099,247 | A * | 8/2000 | Nishio | F01P 5/06 | 123/41.49 |
| 6,196,013 | B1 * | 3/2001 | Kim | F24F 1/027 | 62/262 |
| 8,221,074 | B2 * | 7/2012 | Nelson | F04D 29/526 | 415/213.1 |
| 9,062,888 | B2 * | 6/2015 | Tadokoro | F04D 29/526 | |
| 2005/0161202 | A1 * | 7/2005 | Merkys | F25B 39/04 | 165/122 |
| 2007/0028638 | A1 * | 2/2007 | Eom | F24F 1/027 | 62/262 |
| 2009/0193831 | A1 * | 8/2009 | Kim | F04D 29/526 | 62/259.1 |
| 2011/0017427 | A1 * | 1/2011 | Kato | F04D 29/164 | 165/59 |
| 2011/0217164 | A1 * | 9/2011 | Cote | F04D 29/547 | 415/223 |

FOREIGN PATENT DOCUMENTS

| | | | | |
|---|---|---|---|---|
| JP | 04-297732 | A | | 10/1992 |
| JP | 04278132 | A | * | 10/1992 |
| JP | 05-126364 | A | | 5/1993 |
| JP | 07-158902 | A | | 6/1995 |
| JP | 2001-132990 | A | | 5/2001 |
| JP | 2004211931 | A | * | 7/2004 |
| JP | 2010-127590 | A | | 6/2010 |

OTHER PUBLICATIONS

Office Action dated Dec. 31, 2015 in the corresponding CN application No. 201280062773.1 (with English translation).

Extended European Search Report dated Feb. 1, 2016 in the corresponding EP application No. 12859217.7.

Office Action dated Aug. 8, 2016 issued in corresponding CN patent application No. 201280062773.1 (and English translation).

* cited by examiner

OUTDOOR UNIT AND REFRIGERATION CYCLE APPARATUS INCLUDING THE OUTDOOR UNIT

CROSS REFERENCE TO RELATED APPLICATIONS

This application is a U.S. national stage application of PCT/JP2012/003049 filed on May 10, 2012, and is based on Japanese Patent Application No. 2011-277430 filed on Dec. 19, 2011, the contents of which are incorporated herein by reference.

TECHNICAL FIELD

The present invention relates to an outdoor unit, and a refrigeration cycle apparatus, such as an air-conditioning apparatus or a water heater, including the outdoor unit.

BACKGROUND

There is a conventional outdoor unit for an air-conditioning apparatus, which includes an air path chamber including a heat exchanger disposed at least on the rear side within the unit, a propeller fan disposed on the front side of the heat exchanger and having a plurality of blades, and a bell mouth disposed on the front side of the propeller fan, a machine chamber in which a compressor is disposed, and a partition plate that separates the air path chamber and the machine chamber. A recessed area protruding toward the machine chamber is provided in an area of the partition plate corresponding to the dimension, in the direction in which the propeller fan rotates, of the outer peripheries of the blades in the air path chamber (see, for example, Patent Literature 1).

PATENT LITERATURE

Patent Literature 1: Japanese Unexamined Patent Application Publication No. 2010-127590 (pages 4-5, FIGS. 1-4)

In the invention described in Patent Literature 1, the partition plate has the recessed area protruding toward the machine chamber. Thus, the amount of air sucked into the fan from a side of the partition plate can be increased, and the circumferential distribution of the amount of sucked air can be uniformed. However, since the recessed area provided in the partition plate has a stepped portion or a sharply curved surface in the vertical direction or the rotating direction, noise caused by a rapid change in airflow cannot be sufficiently suppressed.

SUMMARY

The present invention has been made to solve the above problem, and has as its object to provide an outdoor unit that achieves low noise and high efficiency while increasing the amount of air to be sucked into a propeller fan from a partition plate side, and a refrigeration cycle apparatus including the outdoor unit.

An outdoor unit according to the present invention includes an air-sending-device chamber, a machine chamber, and a partition plate. The air-sending-device chamber includes a heat exchanger disposed at least on a rear side within an outdoor unit body, a propeller fan having a plurality of blades and disposed on a front side of the heat exchanger, and a bell mouth disposed on a front side of the propeller fan to face an air outlet. In the machine chamber, a compressor is disposed. The partition plate separates the air-sending-device chamber and the machine chamber. The partition plate has a recessed area protruding from the air-sending-device chamber toward the machine chamber, and an amount of recess of the recessed area takes ascending values from the upper and lower end portions toward the vertical center portion of the partition plate.

A refrigeration cycle apparatus according to the present invention includes the above-described outdoor unit.

According to the present invention, the amount of recess of the partition plate takes ascending values from the upper and lower end portions toward the vertical center portion of the partition plate. For this reason, it is possible to increase the amount of air flowing from the partition plate side to a side surface of the propeller fan in a portion where the propeller fan and the partition plate are close to each other. Thus, since the circumferential distribution of the amount of sucked air can be uniformed, the inflow from the side surface of the propeller fan can be stabilized. Therefore, it is possible to obtain a low-noise and high-efficiency outdoor unit and a refrigeration cycle apparatus including the outdoor unit.

DETAILED DESCRIPTION

[Embodiment 1]

Figure 1:
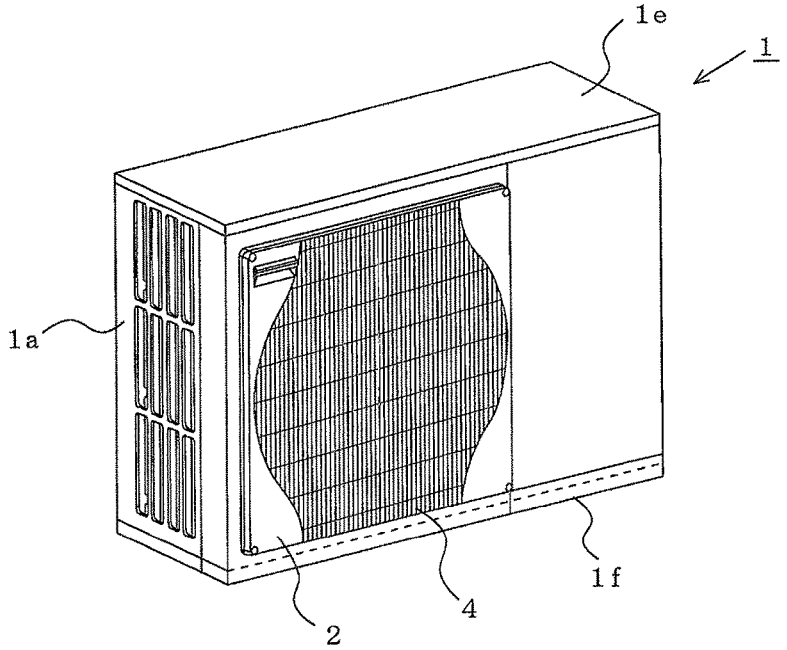
FIG. 1 is an external perspective view of an outdoor unit according to Embodiment 1 of the present invention.

In FIGS. 1 to 4 illustrating an outdoor unit according to Embodiment 1 of the present invention, an outdoor unit body 1 is formed in a box shape having two side surfaces 1*a* and 1*b*, a front surface 1*c*, a rear surface 1*d*, an upper surface 1*e*, and a bottom surface 1*f*. One of the side surfaces, that is, the side surface 1*a* and the rear surface 1*d* each have an aperture (air inlet) through which air is sucked from the outside. A front panel 2 covering the front side of an air-sending-device chamber 6 (to be described later) has an air outlet 3 from which air is blown out. A fan grille 4 is attached to the air outlet 3 in order to maintain safety by preventing a built-in propeller fan 8 (to be described later) from touching an external object.

The inside of the outdoor unit body 1 is partitioned into an air-sending-device chamber 6 and a machine chamber 7 by a partition plate 5. In the air-sending-device chamber 6, a propeller fan 8 is disposed to face the air outlet 3, and has a plurality of (three in FIG. 2) blades 10 attached to the outer periphery of a propeller boss 9. The propeller fan 8 is rotated via a rotation shaft 12 by a fan motor 11 provided on its rear side. A compressor 15, a pipe 16, a board box 17, and so on are disposed in the machine chamber 7. Here, in FIG. 4, the partition plate 5 is illustrated as a vertical surface without forming a recessed area 5*c* (to be described later).

At an inner peripheral edge of the air outlet 3 of the front panel 2, a bell mouth 13 having a radius slightly larger than the radius of rotation of the blades 10 of the propeller fan 8 is provided integrally with or separately from the front panel 2. The bell mouth 13 separates a suction side and a blow side for air to form an air path near the air outlet 3.

An L-shaped heat exchanger 20 is disposed to extend from the rear surface 1*d* toward the side surface 1*a* of the outdoor unit body 1, and includes a plurality of platelike fins stacked in parallel at predetermined intervals, and a plurality of heat transfer pipes orthogonally inserted into the platelike fins. The end portions of the heat transfer pipes near the side surface 1*a* are bent back in a U-shape, and the other end portions are connected to the compressor 15 via a head and a pipe so as to form a refrigerant circuit in which refrigerant circulates. Various devices mounted in the outdoor unit are controlled by a controller provided on a control board 18 in the board box 17 of the machine chamber 7.

Figure 2:
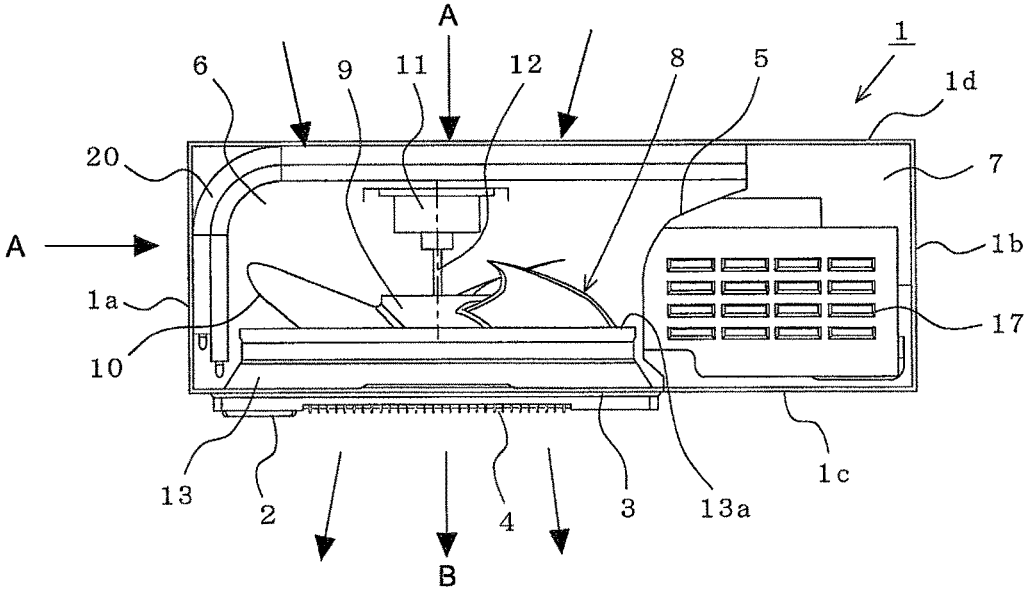
FIG. 2 is a plan view illustrating a state in which a top plate illustrated in FIG. 1 is removed.
Figure 3:
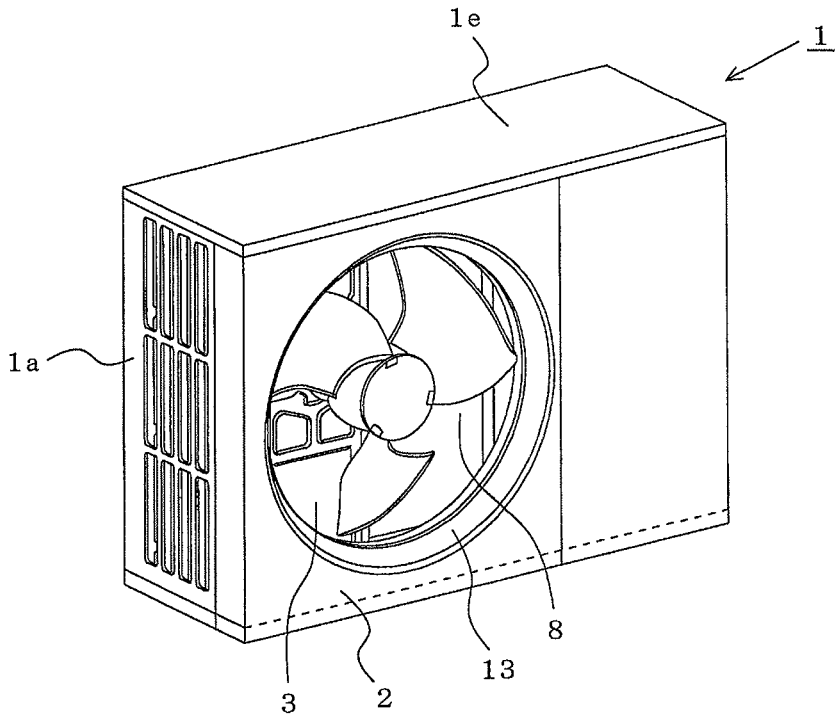
FIG. 3 is a perspective view illustrating a state in which a fan grille illustrated in FIG. 1 is removed.
Figure 4:
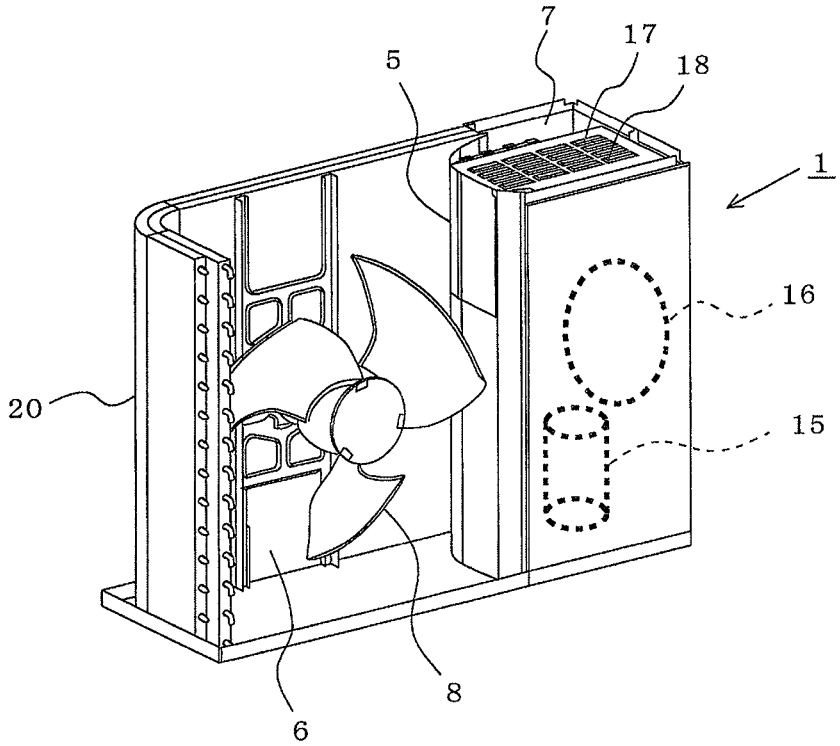
FIG. 4 is a perspective view illustrating a state in which a front panel and the top plate illustrated in FIG. 3 are removed.
Figure 5:
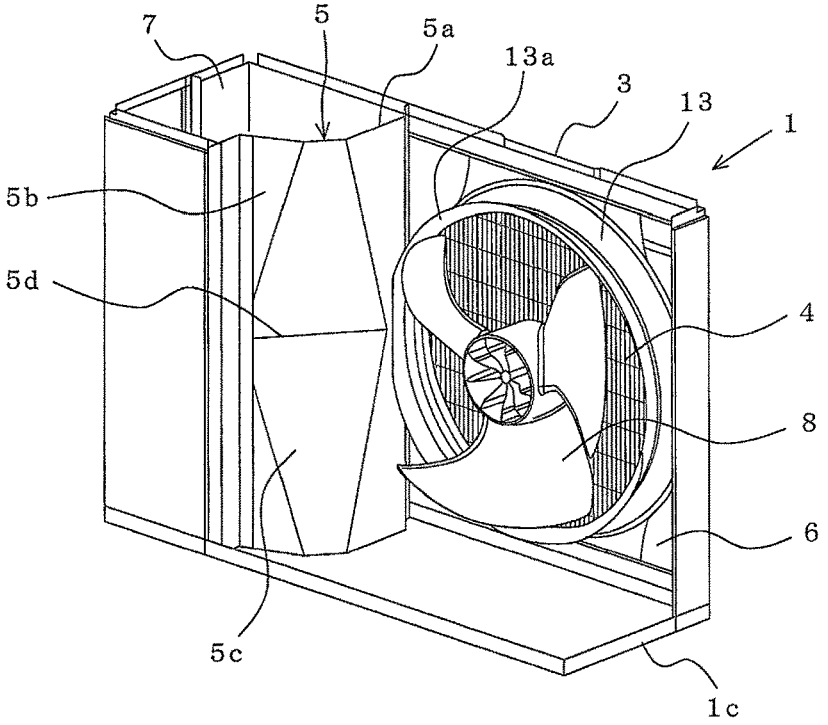
FIG. 5 is a rear perspective view illustrating a state in which a heat exchanger illustrated in FIG. 2 is removed.
Figure 6:
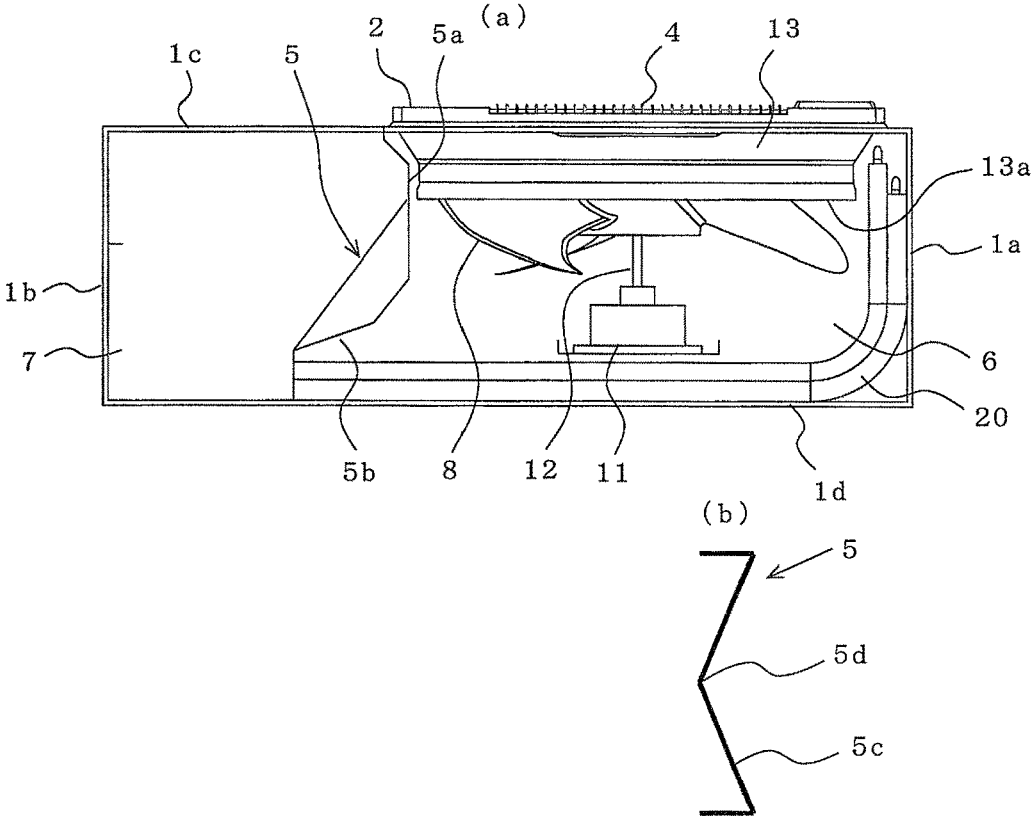
FIG. 6 includes explanatory views illustrating an internal structure of FIG. 5.

FIG. 5 is a rear perspective view illustrating a state in which the heat exchanger of FIG. 2 is removed. FIG. 6 is an explanatory view illustrating an internal structure in the state of FIG. 5. The shape of the partition plate 5 according to Embodiment 1 of the present invention will be described with reference to FIGS. 5 and 6. The partition plate 5 is a plate that separates the air-sending-device chamber 6 and the machine chamber 7. The partition plate 5 of Embodiment 1 includes a flat surface 5*a* extending parallel to a vertical line passing through the rotation shaft 12 of the propeller fan 8 from the front panel 2 (partitioning in a direction to connect the front side and the rear side), and a vertical surface 5*b* extending from an end portion of the heat exchanger 20 toward the flat surface 5*a* (partitioning toward two side surfaces). Here, the flat surface 5*a* and the vertical surface 5*b* are continuously formed, and the air-sending-device chamber 6 and the machine chamber 7 do not communicate with each other.

The partition plate 5 has a recessed area 5*c* that protrudes toward the machine chamber 7 and is recessed toward the corresponding air-sending-device chamber 6 in the up-down direction on the upstream side of a plane including an inner rim portion 13*a* of the bell mouth 13. For this reason, when viewed from, for example, above, a portion where the flat surface 5*a* and the vertical surface 5*b* intersect with each other is chamfered, and the chamfered portion is formed as the recessed area 5*c* having a recess with respect to the up-down direction. The recessed area 5*c* takes ascending values in depth and width (its protrusion length takes ascending values) from the upper and lower end portions toward the center portion. It is particularly preferable that the depth of the recess of the recessed area 5*c* should be largest at a position almost equal in height to the rotation shaft 12 of the propeller fan 8 (to be sometimes referred to as a horizontal plane passing through the center of rotation of the propeller fan 8 hereinafter).

A portion where the depth of the recess is largest will be referred to as a deepest portion 5*d* hereinafter. Also, the depth of the recess will be referred to as an amount of recess hereinafter.

In this way, the portion of the partition plate 5 of Embodiment 1 where the flat surface 5*a* and the vertical surface 5*b* intersect with each other is chamfered. Hence, a wide space on a suction side of the propeller fan 8 can be formed in the air-sending-device chamber 6. Because of the presence of the recessed area 5*c*, the vertical surface 5*b* does not have the recessed area 5*c* on an upper end face and a lower end face, gradually protrudes toward the machine chamber 7 (becomes recessed), and the deepest portion 5*d* is formed near the center portion in the up-down direction. Thus, a space can be ensured on an upper surface side and a bottom surface side of the machine chamber 7 where the compressor 15 and so on are disposed.

Next, the operation of the outdoor unit of Embodiment 1 having the above-described structure will be described.

When the propeller fan 8 is rotated, as illustrated in FIG. 2, outside air A is sucked into the air-sending-device chamber 6 from the air inlets provided in the side surface 1*a* and the rear surface 1*d* of the outdoor unit body 1. Thus, air flows into the heat exchanger 20, and exchanges heat with refrigerant flowing through the heat transfer pipes. The air that has exchanged heat flows through the propeller fan 8 and the bell mouth 13, and is blown outside from the air outlet 3, as indicated by arrows B.

Figure 7:
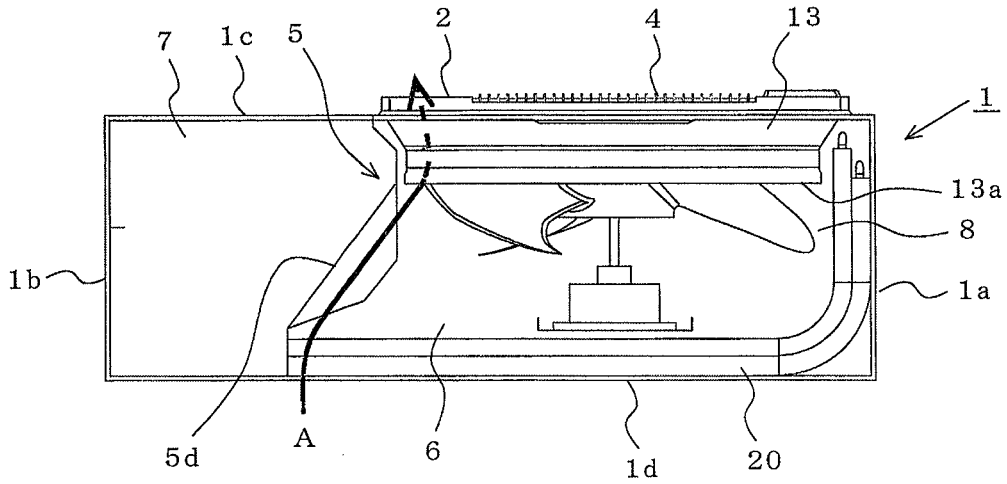
FIG. 7 is an operation explanatory view of Embodiment 1.

In the outdoor unit of Embodiment 1, as illustrated in FIG. 7, part of the airstream A flowing from the rear surface 1*d* of the outdoor unit body 1 into the air-sending-device chamber 6 flows along the partition plate 5 and is then sucked by the propeller fan 8, as indicated by an arrow. The recessed area 5*c* of the partition plate 5 (see FIG. 5) is configured to gradually protrude from the upper and lower end portions toward the machine chamber 7, and the deepest portion 5*d* at the position corresponding to the center of rotation of the propeller fan 8 is formed. Since the distance to the propeller fan 8 is longest, the amount of inflow air is made larger than in the case of a partition plate that does not have the recessed area 5*c*.

Since the range of the recessed area 5*c* of the partition plate 5 is located upstream of the plane connecting the inner rim portion 13*a* of the bell mouth 13, inflow air along the partition plate 5 easily flows into an inner side of the bell mouth 13, as indicated by an arrow in FIG. 7.

Figure 8:
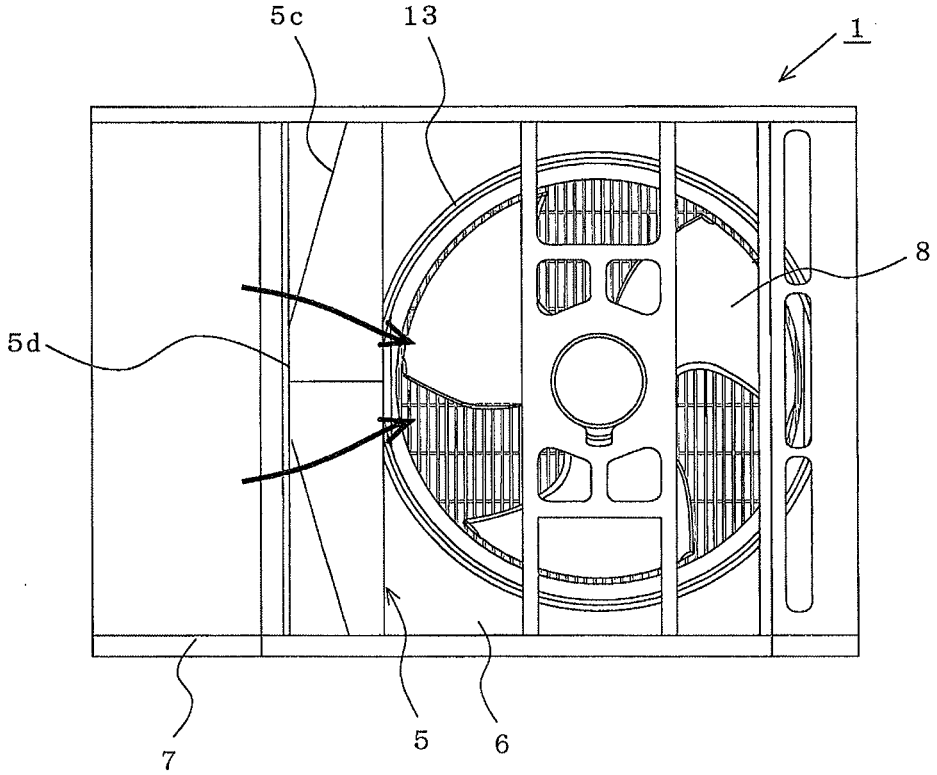
FIG. 8 is an operation explanatory view of Embodiment 1.

Further, since the recessed area 5*c* of the partition plate 5 has the deepest portion 5*d* at the position corresponding to the center of rotation of the propeller fan 8, streams are produced to collect from the upper and lower sides of the horizontal plane passing through the center of rotation of the propeller fan 8 at the center of rotation of the propeller fan 8, as illustrated in FIG. 8. As a result, the amount of air in a portion where the propeller fan 8 and the partition plate 5 are close to each other can be increased, and a uniform air suction distribution can be obtained in the circumferential direction of the propeller fan 8.

As described above, in the outdoor unit according to Embodiment 1, the partition plate 5 having fixed dimensions in the widthwise direction and the depth direction of the outdoor unit body 1 has the recessed area 5*c* protruding toward the machine chamber 7 in the height direction of the outdoor unit body 1 on the upstream side of the plane passing through the inner rim portion 13*a* of the bell mouth 13. This recessed area 5*c* is structured such that its amount of recess takes ascending values toward the height position corresponding to the center of rotation of the propeller fan 8 and such that the deepest portion 5*d* having the largest depth is formed at the same height position as the center of rotation of the propeller fan 8. This can uniformize, in the circumferential direction, the distribution of air from the side surface of the propeller fan 8.

For this reason, fluctuations in flow of air sucked by the propeller fan 8 are reduced, and the air constantly flows around the blades 10. This can reduce fluctuations in force produced on the surfaces of the blades 10, and can thereby obtain a low-noise and high-efficiency outdoor unit.

[Embodiment 2]

Figure 9:
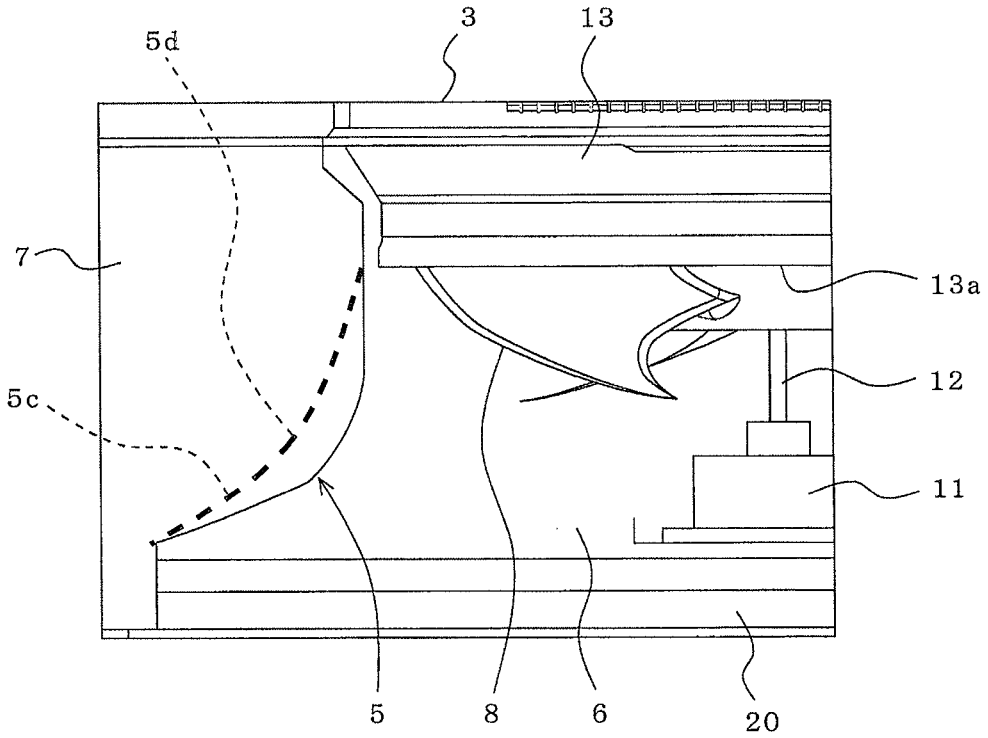
FIG. 9 is an explanatory view illustrating the principal part of an outdoor unit according to Embodiment 2 of the present invention.

FIG. 9 is an explanatory view illustrating the principal part of an outdoor unit according to Embodiment 2 of the present invention. Components having functions identical or similar to those in the outdoor unit of Embodiment 1 are denoted by the same reference numerals in Embodiment 2.

In Embodiment 2, a partition plate 5 provided between a front panel 2 and an end portion of a heat exchanger 20 is formed by a curved surface protruding toward an air-sending-device chamber 6. The shape of a portion of the curved surface at a height position corresponding to the center of rotation of a propeller fan 8 is indicated by a dashed line.

That is, in Embodiment 2, the partition plate 5 is formed by a curved surface convex toward the air-sending-device chamber 6, so that the curvature of the partition plate 5 takes descending values from the upper and lower end portions toward the center portion in the up-down direction (vertical direction), and is minimized at the position corresponding to the center of rotation of the propeller fan 8. In other words, the partition plate 5 gradually protrudes from a position indicated by a solid line to the position indicated by the dashed line at the position corresponding to the center of rotation of the propeller fan 8 (that is, protrudes toward a machine chamber 7), so that a portion of the partition plate 5 on the side of the air-sending-device chamber 6 is recessed to form a deepest portion 5*d* at the position corresponding to the center of rotation of the propeller fan 8.

While offering advantages substantially similar to those of Embodiment 1, Embodiment 2 has another advantage that since the partition plate 5 is formed by a curved surface, the air can smoothly flow along the wall surface. Further, the area on the side of the air-sending-device chamber 6 is increased by minimizing the curvature of the curved surface (by forming the deepest portion 5*d*) at the height position corresponding to the center of rotation of the propeller fan 8. Hence, the amount of air sucked from the partition plate 5 toward the side surface of the propeller fan 8 can be increased to uniform the air suction distribution in the circumferential direction.

As described above, in the outdoor unit according to Embodiment 2, the partition plate 5 is shaped into a curved surface convex toward the air-sending-device chamber 6 in a horizontal cross section, so that the curvature of the partition plate 5 takes descending values from the upper and lower end portions toward the center portion in the up-down direction (vertical direction), and is minimized (deepest portion 5*d*) at the height position corresponding to the center of rotation of the propeller fan 8. Hence, similarly to Embodiment 1, the distribution in the circumferential direction of the amount of air sucked from the side surface of the propeller fan 8 can be uniformed to obtain a low-noise and high-efficiency outdoor unit.

[Embodiment 3]

Figure 10:
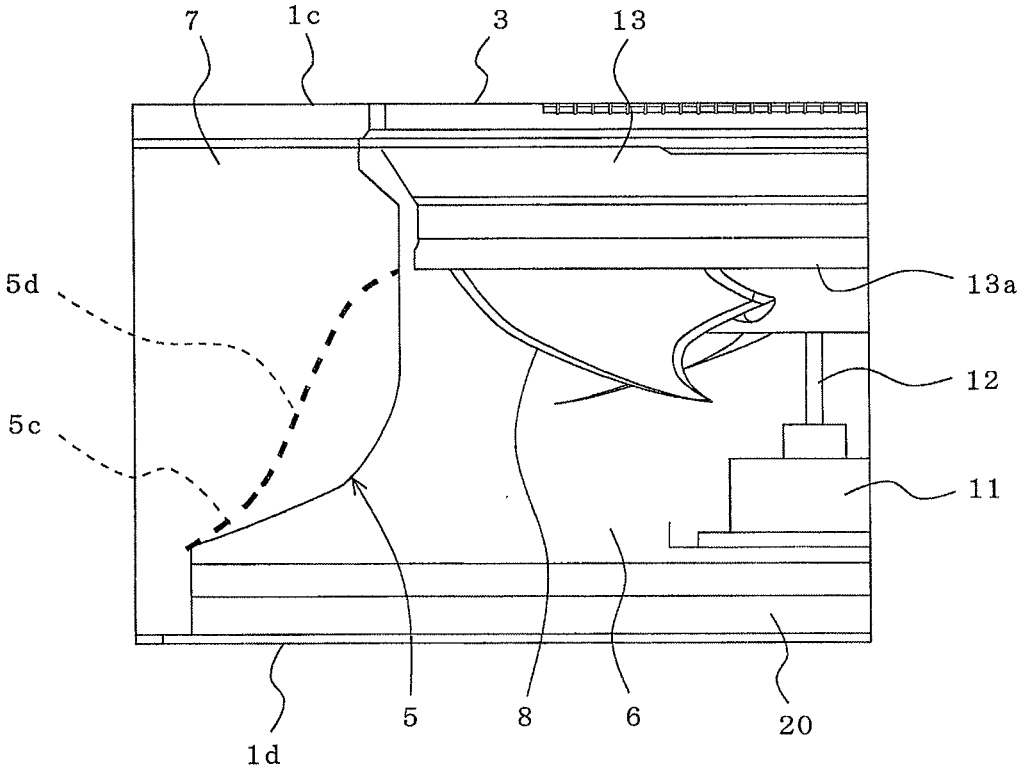
FIG. 10 is an explanatory view illustrating the principal part of an outdoor unit according to Embodiment 3 of the present invention.

FIG. 10 is an explanatory view illustrating the principal part of an outdoor unit according to Embodiment 3 of the present invention. Components having functions identical or similar to those of the outdoor unit of Embodiment 1 are denoted by the same reference numerals in Embodiment 3. In Embodiment 3, the upper and lower portions of a partition plate 5 provided between a front panel 2 and the end portion of a heat exchanger 20 are formed by curved surfaces protruding toward an air-sending-device chamber 6. A horizontal cross section of the partition plate 5 at a height position corresponding to the center of rotation of a propeller fan 8 is S-shaped, as indicated by a dashed line.

That is, in Embodiment 3, the maximum curvature of a curved surface, which is convex to an air-sending-device side, of the partition plate 5 takes descending values from the upper and lower end portions toward the center portion in the up-down direction to form a recess on the side of the air-sending-device 6. Moreover, at the height position corresponding to a rotation shaft 12 of the propeller fan 8, the curved surface has a substantially S-shaped horizontal cross section so as to be convex toward the air-sending-device chamber 6 on the side of the heat exchanger 20 (upstream side) and to be convex toward a machine chamber 7 on the side of a front surface 1*c* (downstream side).

The amount of recess on the side of the air-sending-device chamber 6 takes ascending values from the upper end portion and the lower end portion of the partition plate 5 toward the center portion in the up-down direction, and the curvature of the horizontal cross section is minimized (deepest portion 5*d*) at the height position corresponding to the center of rotation of the propeller fan 8.

While offering advantages substantially similar to those of Embodiment 1 or 2, Embodiment 3 has another advantage that since the front side of the partition plate 5 is shaped to be convex toward the machine chamber 7, an airstream flowing along the partition plate 5 can be perpendicularly sucked from the side surface of the propeller fan 8. This can uniform the air suction distribution in the circumferential direction of the propeller fan 8.

As described above, in the outdoor unit according to Embodiment 3, the recessed area 5*c* of the partition plate 5 is shaped into a curved surface, so that the curvature of the partition plate 5 changes at the position corresponding to the rotation shaft 12 of the propeller fan 8, and the horizontal cross section is substantially S-shaped so as to be convex toward the air-sending-device chamber 6 on the side of the heat exchanger 20 (upstream side) and to be convex toward the machine chamber 7 on the side of the front surface 1*c* (downstream side). Hence, similarly to Embodiments 1 and 2, the distribution of an airstream flowing from the side surface of the propeller fan 8 can be uniformed in the circumferential direction to obtain a low-noise and high-efficiency outdoor unit.

[Embodiment 4]

Figure 11:
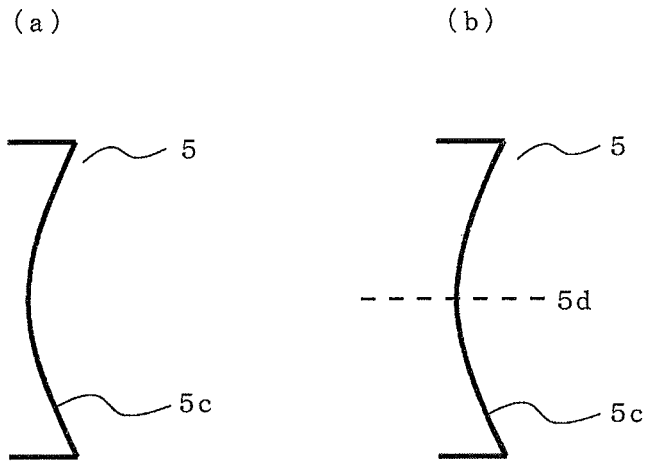
FIG. 11 includes schematic explanatory views of a partition plate in an outdoor unit according to Embodiment 4 of the present invention.

FIG. 11 includes schematic explanatory views of a partition plate in an outdoor unit according to Embodiment 4 of the present invention. Components having functions identical or similar to those of Embodiment 1 are denoted by the same reference numerals in Embodiment 4. In Embodiment 4, a recessed area 5*c* provided in a partition plate 5 is shaped so as not to have an angular portion. FIG. 11(*a*) illustrates a recessed area 5*c* formed in an arc that has continuous variations in the vertical direction.

In FIG. 11(*b*), a partition plate 5 has a recessed area 5*c* formed in an arc that has continuous smooth variations in the vertical direction. The recessed area 5*c* has a deepest portion 5*d* at a height position corresponding to the center of rotation of a propeller fan 8 and is configured to have upper and lower parts symmetrical with respect to the deepest portion 5*d* to uniform the amount of suction air in the up-down direction. In other Embodiments as well, the recessed area 5*c* can have upper and lower parts symmetrical with respect to the deepest portion 5*d*.

As described above, while offering advantages substantially similar to those of Embodiments 1 to 3, Embodiment 4 has another advantage that the partition plate 5 has the recessed area 5*c* formed in an arc that has continuous variations in the vertical direction so as not to form an angular portion, or the recessed area 5*c* has the deepest portion 5*d* at the height position in the recessed area 5*c* corresponding to the center of rotation of the propeller fan 8 and is configured to have upper and lower parts symmetrical with respect to the deepest portion 5*d*. Hence, it is possible to uniformize the distribution in the circumferential direction of the amount of air sucked from the side surface of the propeller fan 8, and to obtain a low-noise and high-efficiency outdoor unit.

[Embodiment 5]

Figure 12:
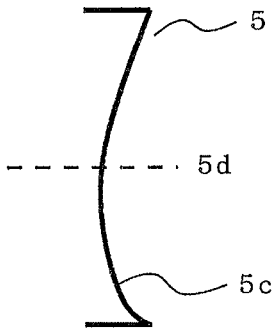
FIG. 12 is a schematic explanatory view of a partition plate in an outdoor unit according to Embodiment 5 of the present invention.

FIG. 12 is a schematic explanatory view of a partition plate in an outdoor unit according to Embodiment 5 of the present invention. Components having functions identical or similar to those of the outdoor unit of Embodiment 1 are denoted by the same reference numerals in Embodiment 5. In Embodiment 5, a partition plate 5 has an arc-shaped recessed area 5*c* formed in the vertical direction, and the recessed area 5*c* has a deepest portion 5*d* at a height position corresponding to the center of rotation of a propeller fan 8. A recess on one of the upper and lower sides of the deepest portion 5*d* is deeper than that on the other side (FIG. 12 illustrates a case in which the recess on the lower side of the deepest portion 5*d* is deeper than that on the upper side). In other Embodiments as well, recesses with different characteristics can be formed on the upper and lower sides of the deepest portion 5*d*.

While offering advantages substantially similar to those of Embodiments 1 to 4, Embodiment 5 has another advantage that the recess of the partition plate 5 is deeper on one of the upper and lower sides of a horizontal plane passing through the center of rotation of the propeller fan 8 than on the other side. Hence, the amount of air increases in the deeper recess, and this can uniformize the suction distribution in the circumferential direction of the propeller fan 8. When a wall surface is provided on one of the upper surface side and the bottom surface side of an installation place of the outdoor unit, the amount of sucked air decreases on the side where the wall surface is provided. According to Embodiment 5, when the recess of the partition plate 5 on the side where the wall surface is provided is made deeper, the amount of air sucked from the side surface of the propeller fan 8 can be increased.

In Embodiment 5, similarly to Embodiments 1 to 4, the circumferential distribution of the amount of air sucked from the side surface of the propeller fan 8 can be uniformed to obtain a low-noise and high-efficiency outdoor unit.

[Embodiment 6]

Figure 13:
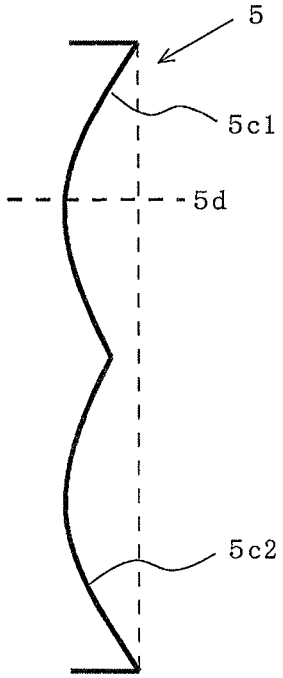
FIG. 13 is a schematic explanatory view of a partition plate in an outdoor unit according to Embodiment 6 of the present invention.

FIG. 13 is a schematic explanatory view of a partition plate in an outdoor unit according to Embodiment 6 of the present invention. Components having functions identical or similar to those of the outdoor unit of Embodiment 1 are denoted by the same reference numerals in Embodiment 6.

Embodiment 6 relates to a partition plate 5 of an outdoor unit in which a plurality of propeller fans 8*a* and 8*b* are arranged in the up-down direction in an air-sending-device chamber 6.

That is, the partition plate 5 has arc-shaped recessed areas 5*c*1 and 5*c*2 formed in the vertical direction in correspondence with the propeller fans 8*a* and 8*b*, respectively (FIG. 13 illustrates an example in which the recessed areas 5*c*1 and 5*c*2 are formed if two propeller fans are provided). The amount of recess of the recessed area 5*c*1 of the partition plate 5 is maximized (deepest portion 5*d*) in a horizontal plane passing through the center of rotation of at least one of the plurality of propeller fans 8*a* and 8*b* (for example, 8*a*).

While the partition plate 5 has the plurality of arc-shaped recessed areas 5*c*1 and 5*c*2 formed in the vertical direction in the above description, the shape of the recessed area 5*c* is not limited thereto. Appropriate shapes of the recessed areas 5*c* of the partition plates 5 in the outdoor units according to Embodiments 1 to 5 can be used.

In Embodiment 6, the deepest portion 5*d* of the recessed area 5*c*1 of the partition plate 5 is provided in the horizontal plane passing through the center of rotation of at least one of the plurality of propeller fans 8*a* and 8*b* (for example, 8*a*). Hence, similarly to Embodiments 1 to 5, it is possible to uniformize the circumferential distribution of the amount of air sucked from the side surfaces of the propeller fans 8*a* and 8*b* and thereby obtain a low-noise and high-efficiency outdoor unit.

[Embodiment 7]

Figure 14:
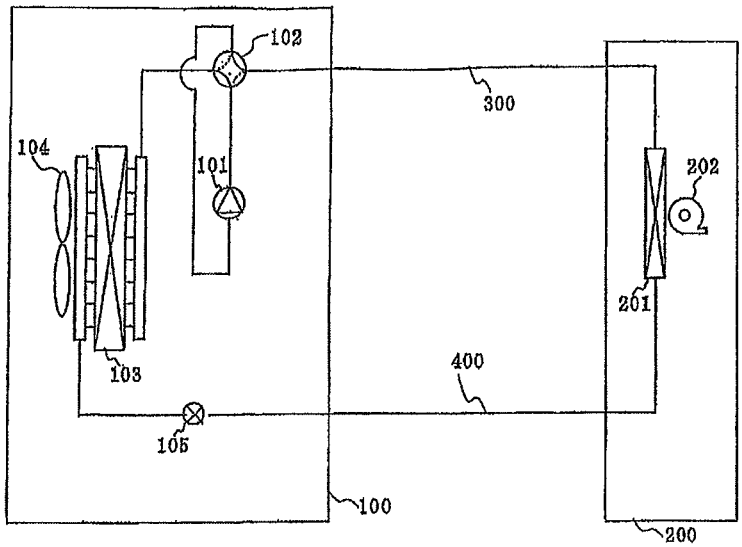
FIG. 14 is a configuration view of an air-conditioning apparatus according to Embodiment 7 of the present invention.

FIG. 14 is a configuration view of an air-conditioning apparatus according to Embodiment 7 of the present invention. In Embodiment 7, the air-conditioning apparatus will be exemplified as a refrigeration cycle apparatus including an outdoor unit 100 provided with the above-described air-sending device and so on. The air-conditioning apparatus of FIG. 14 includes an outdoor unit 100 and an indoor unit 200, which are connected by refrigerant pipes to form a refrigerant circuit in which a refrigerant circulates. Of the refrigerant pipes, a pipe through which a gas-phase refrigerant (gas refrigerant) flows is referred to as a gas pipe 300, and a pipe through which a liquid-phase refrigerant (typically a liquid refrigerant, but sometimes a two-phase gas-liquid refrigerant) flows is referred to as a liquid pipe 400.

In Embodiment 7, the outdoor unit 100 includes a compressor 101, a four-way valve 102, an outdoor-side heat exchanger 103, an outdoor-side air-sending device 104, and an expansion device (expansion valve) 105.

The compressor 101 compresses and discharges a sucked refrigerant. It is assumed herein that the compressor 101 includes an inverter device and so on and can finely change the capacity thereof (the amount of refrigerant to be discharged per unit time) by arbitrarily changing the operation frequency. The four-way valve 102 switches the flow of refrigerant between a cooling operation and a heating operation on the basis of instructions from a control device (not illustrated).

The outdoor-side heat exchanger 103 exchanges heat between the refrigerant and the air (outdoor air). For example, in a heating operation, the outdoor-side heat exchanger 103 functions as an evaporator, and exchanges heat between a low-pressure refrigerant flowing from the liquid pipe 400 and the air to evaporate and gasify the refrigerant. In a cooling operation, the outdoor-side heat exchanger 103 functions as a condenser, and exchanges heat between a refrigerant compressed by the compressor 101 and flowing from the four-way valve 102 and the air to condense and liquefy the refrigerant. To efficiently exchange heat between the refrigerant and the air, the outdoor-side heat exchanger 103 is provided with the outdoor-side air-sending device 104 including the air-sending-device chamber 6, the machine chamber 7, and so on described above in conjunction with Embodiments 1 to 6. In the outdoor-side air-sending device 104, the rotation speed of a fan may also be finely changed by arbitrarily changing the operation frequency of a fan motor by an inverter device. The expansion device 105 is provided to adjust the pressure of the refrigerant and so on by changing its opening degree.

In contrast, the indoor unit 200 includes a load-side heat exchanger 201 and a load-side air-sending device 202. The load-side heat exchanger 201 exchanges heat between the refrigerant and the air. For example, in a heating operation, the load-side heat exchanger 201 functions as a condenser, exchanges heat between a refrigerant flowing from the gas pipe 300 and the air to condense and liquefy the refrigerant (or transform it into a two-phase gas-liquid refrigerant), and delivers the refrigerant to the liquid pipe 400. In contrast, in a cooling operation, the load-side heat exchanger 201 functions as an evaporator, exchanges heat between, for example, a refrigerant brought into a low-pressure state by the expansion device 105 and the air to cause the refrigerant to remove heat from the air and thereby evaporate and gasify the refrigerant, and delivers the refrigerant to the gas pipe 300. In the indoor unit 200, the load-side air-sending device 202 is also provided to adjust the flow of air that exchanges heat. The operation speed of the load-side air-sending device 202 is determined by, for example, user setting. Although the present invention is not particularly limited to a specific type of air-sending device, the air-sending device described in conjunction with Embodiments 1 to 4 can also be used as the load-side air-sending device 202.

As described above, the air-conditioning apparatus of Embodiment 7 uses the outdoor unit (air-sending device) described in conjunction with Embodiments 1 to 6 as the outdoor unit 100. This can attain, for example, low noise and prevent, for example, damage.

INDUSTRIAL APPLICABILITY

In Embodiment 7, the above-described outdoor unit according to each of Embodiments 1 to 6 can be used not only in an air-conditioning apparatus, but also in, for example, a refrigeration cycle apparatus that constitutes a water heater. Thus, it is possible to obtain a low-noise and high-efficiency refrigeration cycle apparatus. The outdoor unit according to the present invention can also be widely used in, for example, various apparatuses and facilities in which an air-sending device is installed.

The invention claimed is:

1. An outdoor unit comprising:

an air-sending-device chamber including a heat exchanger disposed at least on a rear side within an outdoor unit body, a propeller fan having a plurality of blades and disposed on a front side of the heat exchanger, and a bell mouth disposed on a front side of the propeller fan to face an air outlet;

a machine chamber in which a compressor is disposed; and a partition plate that separates the air-sending-device chamber and the machine chamber, wherein the partition plate has a recessed area protruding from the air-sending-device chamber toward the machine chamber, an amount of recess of the recessed area takes ascending values from upper and lower end portions toward a vertical center portion of the partition plate, a horizontal cross section of the recessed area of the partition plate is defined by a curved surface convex from the machine chamber toward the air-sending-device chamber, a horizontal distance between an upstream end of a blade of the plurality of blades of the propeller fan and the curved surface, which is convex from the machine chamber toward the air-sending-device chamber which includes the propeller fan, is maximized at a position equal in height to a center of rotation of the propeller fan, wherein the horizontal distance is defined at a closest part of the curved surface which is closest to the upstream end in the horizontal cross section, and a curvature of the curved surface is minimized at the position equal in height to the center of rotation of the propeller fan, and an entirety of the partition plate is disposed to a left or right side of the propeller fan, and in a top plan view of the outdoor unit the partition plate is not disposed over the propeller fan.

2. The outdoor unit of claim 1, wherein an amount of protrusion of the recessed area of the partition plate toward the machine chamber takes ascending values from the upper and lower end portions toward the vertical center portion of the partition plate, and the amount of recess of the recessed area is maximized at the position equal in height to the center of rotation of the propeller fan.

3. The outdoor unit of claim 1, wherein the recessed area of the partition plate is formed by a curved surface that has continuous variations in a vertical direction of the partition plate.

4. The outdoor unit of claim 1, wherein the recessed area of the partition plate is symmetrical with respect to a horizontal plane passing through the center of rotation of the propeller fan.

5. The outdoor unit of claim 1, wherein a recess of the recessed area of the partition plate is deeper on one of upper and lower sides of a horizontal plane passing through the center of rotation of the propeller fan than on the other side.

6. The outdoor unit of claim 1, further comprising:

a plurality of propeller fans arranged in an up-down direction of the outdoor unit body, wherein the partition plate has the recessed area corresponding to each of the plurality of propeller fans, and an amount of recess of the recessed area corresponding to at least one of the plurality of propeller fans is maximized in a horizontal plane passing through the center of rotation of the at least one of the propeller fans.

7. The outdoor unit of claim 1, wherein an entirety of the partition plate is generally vertical from a top to bottom of the air-sending-device chamber and, in the top plan view the partition plate is disposed entirely to the left or right side of the propeller fan.

8. A refrigeration cycle apparatus comprising an outdoor unit, the outdoor unit comprising:

an air-sending-device chamber including a heat exchanger disposed at least on a rear side within an outdoor unit body, a propeller fan having a plurality of blades and disposed on a front side of the heat exchanger, and a bell mouth disposed on a front side of the propeller fan to face an air outlet;

a machine chamber in which a compressor is disposed; and a partition plate that separates the air-sending-device chamber and the machine chamber, wherein the partition plate has a recessed area protruding from the air-sending-device chamber toward the machine chamber, an amount of recess of the recessed area takes ascending values from upper and lower end portions toward a vertical center portion of the partition plate, a horizontal cross section of the recessed area of the partition plate is defined by a curved surface convex from the machine chamber toward the air-sending-device chamber, a horizontal distance between an upstream end of a blade of the plurality of blades of the propeller fan and the curved surface, which is convex from the machine chamber toward the air-sending-device chamber which includes the propeller fan, is maximized at a position equal in height to a center of rotation of the propeller fan, wherein the horizontal distance is defined at a closest part of the curved surface which is closest to the upstream end in the horizontal cross section, and a curvature of the curved surface is minimized at the position equal in height to the center of rotation of the propeller fan, and an entirety of the partition plate is disposed to a left or right side of the propeller fan, and in a top plan view of the outdoor unit the partition plate is not disposed over the propeller fan.

9. The refrigeration cycle apparatus of claim 8, wherein an entirety of the partition plate is generally vertical from a top to bottom of the air-sending-device chamber and, in the top plan view the partition plate is disposed entirely to the left or right side of the propeller fan.

* * * * *